US005342047A

United States Patent [19]

Heidel et al.

[11] Patent Number: 5,342,047

[45] Date of Patent: Aug. 30, 1994

[54] TOUCH SCREEN VIDEO GAMING MACHINE

[75] Inventors: Raymond Heidel; Richard E. Snider, both of Henderson, Nev.

[73] Assignee: Bally Gaming International, Inc., Las Vegas, Nev.

[21] Appl. No.: 864,959

[22] Filed: Apr. 8, 1992

[51] Int. Cl.[5] ..... A63F 9/22

[52] U.S. Cl. ..... 273/85 CP; 273/138 A

[58] Field of Search ..... 273/138 A, 138 R, 143 R, 273/85 CP, 85 G, 237, 269, DIG. 28

[56] References Cited

U.S. PATENT DOCUMENTS 4,727,544 2/1988 Brunner et al. ..... 371/21

4,856,787 8/1989 Itkis ..... 273/237

5,042,809 8/1991 Richardson ..... 273/138 A

FOREIGN PATENT DOCUMENTS 2147773 5/1985 United Kingdom ..... 273/138 A

OTHER PUBLICATIONS

Advertisement in Play Meter Magazine, Dec. 1992, vol. 17, No. 13.

*Primary Examiner*—Jessica J. Harrison

*Attorney, Agent, or Firm*—Jenner & Block

[57] ABSTRACT

In video lottery terminals that employ touch screens to permit a number of different games to be played on the same machine, the play of certain games can be improved by using electromechanical game buttons in conjunction with touch screen controls.

12 Claims, 4 Drawing Sheets

TOUCH SCREEN VIDEO GAMING MACHINE

TECHNICAL FIELD

The invention relates to video gaming machines and in particular to video gaming machines employing touch screen displays.

BACKGROUND OF THE INVENTION

Video gaming machines are currently finding application as video lottery terminals in state administered lotteries. As video lottery terminals these gaming machines essentially function in the same manner as video gaming machines found in state regulated casinos except that they generally use ticket printers to print tickets that can be exchanged for cash payments instead of paying winning amounts though a coin hopper as in conventional gaming machines.

Because there are usually only a few machines in any one establishment and because the public enjoys a variety of games, many of the video lottery terminals on the market today offer a number of games that can be selected by the player. In order to permit a machine to operate more than one game, touch screens are used so that game controls that are specific to each game can be displayed. Since video games can differ substantially in their mode of operation from game to game, it is generally not possible to use the same set of electromechanical control buttons to control different games such as poker, slot machines or keno. Therefore touch screens have been used to display game controls so that a variety of games can be played on the same video lottery terminal.

However, it has been found that the display of game controls on the video display can significantly slow play in certain circumstances. For example many video poker players play the game by touch without having to look at the screen which is generally necessary when using a touch screen. By requiring a player to look at the screen and to make hand movements that can be somewhat awkward, the rate of game play and hence the earning potential, especially for some of the more popular games such as video poker, is reduced.

SUMMARY OF THE INVENTION

It is therefore an object of the invention to provide a video gaming machine having a touch screen with inputs from both buttons located on the machine housing and the touch screen to control games played on the machine.

It is an additional object of the invention to provide a video gaming machine that is capable of playing a number of different games on a touch screen with a number of game control buttons located on the machine housing that can be used along with or instead of the touch screen to control at least one of the games. For certain games, the machine can be configured such that inputs from the game control buttons would not be used to control the game.

It is a further object of the invention to provide a video gaming machine having a touch screen with a number of machine control buttons and game control buttons located on the machine housing where the game control buttons and the machine control buttons can be used alternatively with the touch screen to control the machine and to control a game played on the machine. In some instances the machine can be configured such that for some games the machine buttons can be used alternatively with the touch screen to control the machine but the game control buttons cannot be used to control these games.

It is still a further object of the invention to provide a video game machine having a touch screen with control buttons where the labels on the buttons can be changed under machine control in order to accommodate different games.

DETAILED DESCRIPTION OF THE INVENTION

Figure 1:
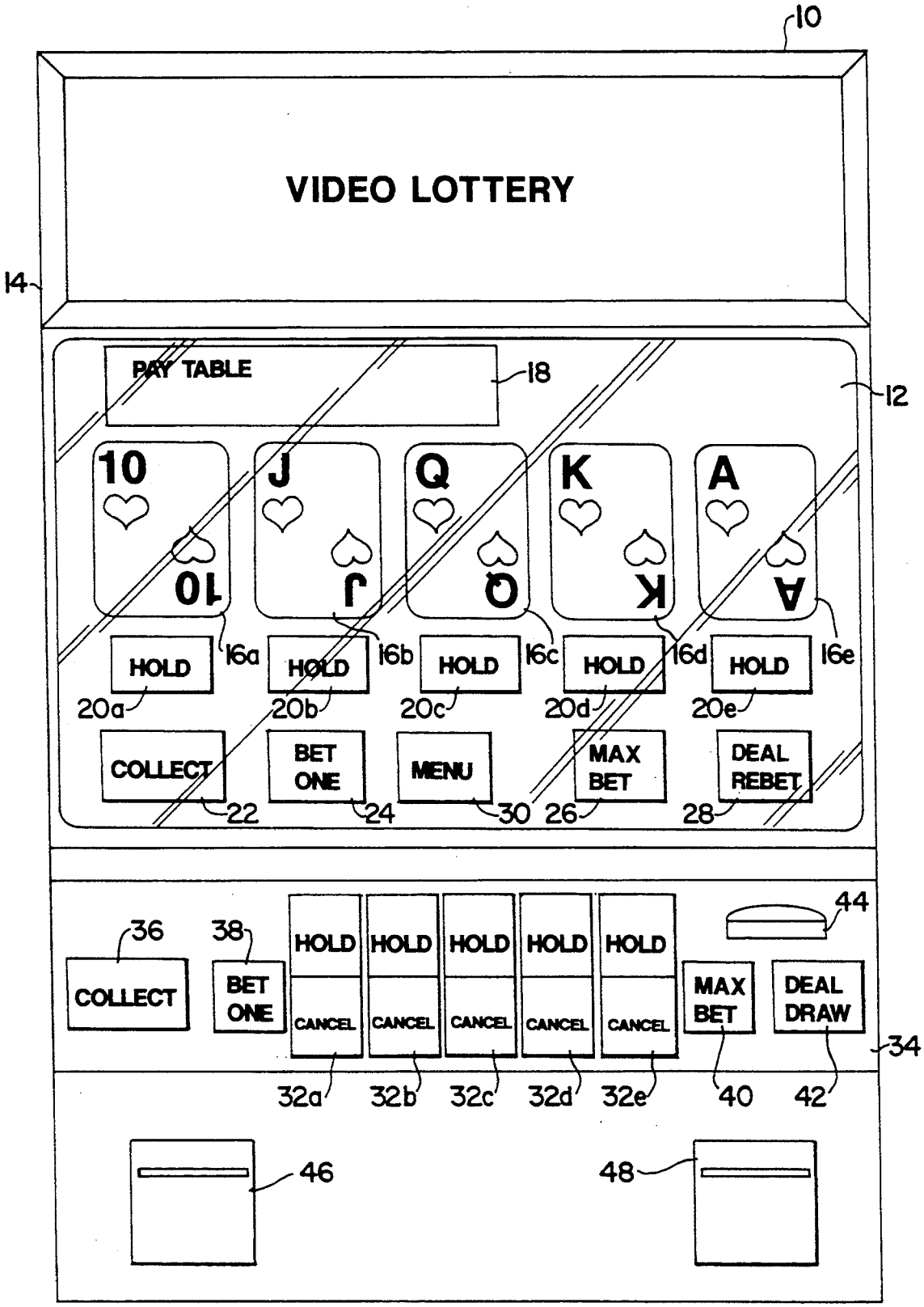
FIG. 1 is a front view of a video gaming machine employing a touch screen.

Illustrated in FIG. 1 is a representative example of a video lottery terminal 10 having a touch screen 12 secured within a housing 14. In the embodiment of the invention shown in FIG. 1 a draw poker game is displayed on the touch screen 12. Included on this display are five cards 16*a*–16*e* along with a paytable 18 that provides the player with the values for various winning combinations of cards. Also displayed on the screen 12 are five hold indicators 20*a*–20*e* that designate areas on the screen 12 that can be touched by the player to hold cards 16*a*–16*e* in the draw poker game. In some embodiments the cards 16*a*–16*e* can be touched along with or instead of the hold indicators 20*a*–20*e* to perform the hold function. The screen 12 also displays machine control indicators that are used to control the basic operation of the machine such as a collect indicator 22, a bet one indicator 24, a bet max indicator 26 and a deal/rebet indicator 28 that can be used to control the operation of the machine 10. For video lottery terminals that contain a number of games a menu indicator 30 can be displayed which permits the player to select the particular game he desires to play.

The arrangement as described above where the video lottery terminal 10 can be controlled and games played by touching the screen 12 is particularly useful in machines that contain a number of games because it is relatively straight forward to program in a variety of game control indicators to accommodate games having widely differing characteristics. It also has the advantage of eliminating the expense of electromechanical game and control buttons. However, there are several games such as draw poker that can be played faster using game control buttons mounted on a video gaming machine. To that end the machine 10 includes five hold/cancel buttons 32*a*–32*e* mounted on a deck portion 34 of the machine housing 14. In this embodiment of the invention a set of machine control buttons including a collect button 36, a bet one button 38, a max bet button 40 and a deal/draw button 42 are mounted on the deck 34 as well. Machine controls such as the buttons 36–42 and the indicators 22–28 can generally be used with all of the games in the machine 10 whereas the game control buttons 32*a*–32*e* and the indicators 16*a*–16*e* are usually only usable with one game. The video lottery terminal 10 also includes a coin acceptor 44, a bill acceptor 46 and a ticket printer 48.

Figure 2A:
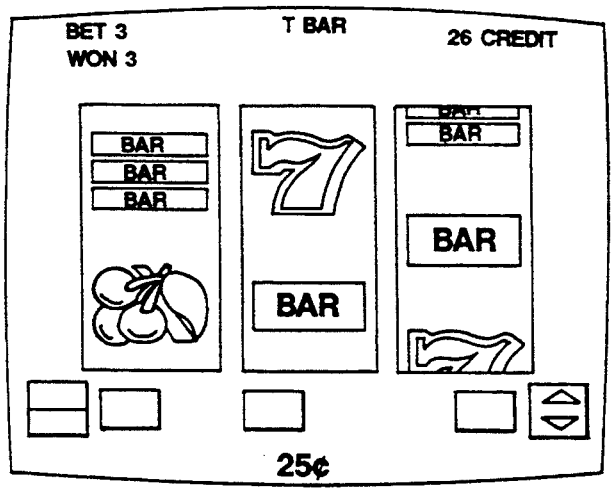
FIGS. 2*a*–2*d* are screen displays of various games that can be played on the machine of FIG. 1.
Figure 2B:
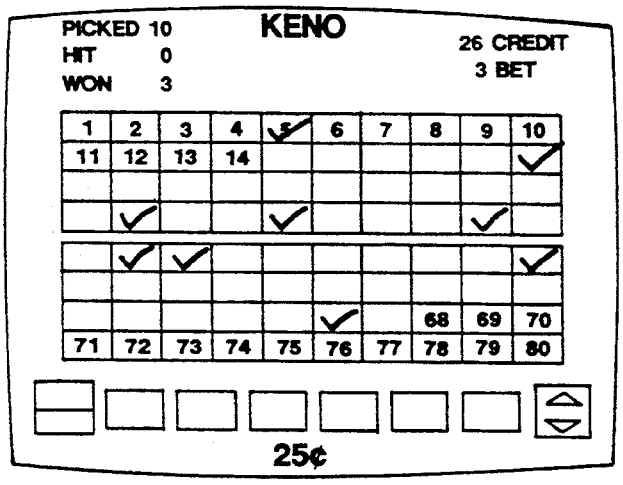
Figure 2C:
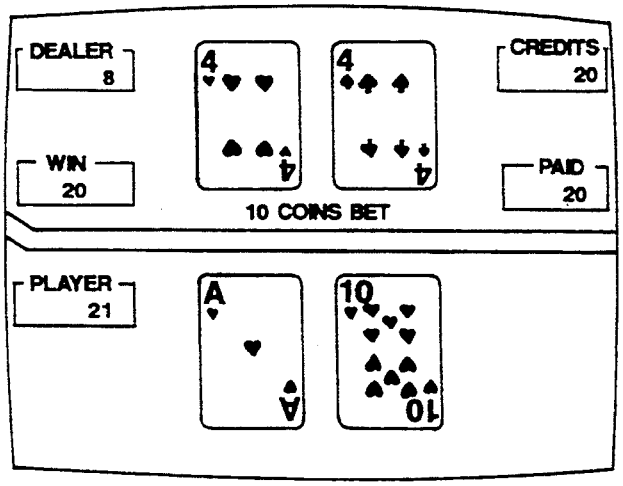
Figure 2D:
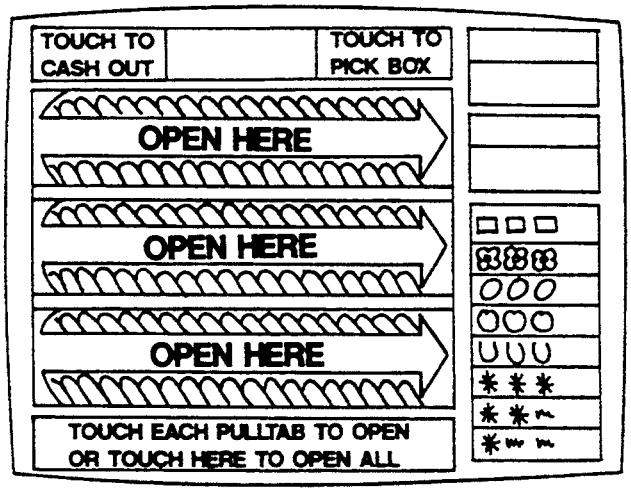

FIGS. 2*a*–2*d* are provided to illustrate the different types of games that can be implemented on the video lottery terminal 10. FIG. 2*a* is a screen display of a video slot machine game. FIG. 2*b* is a screen display of a keno game. FIG. 2*c* is a screen display of a twenty-one game and FIG. 2*d* is a screen display of a video implementation of an instant lottery game.

Figure 3:
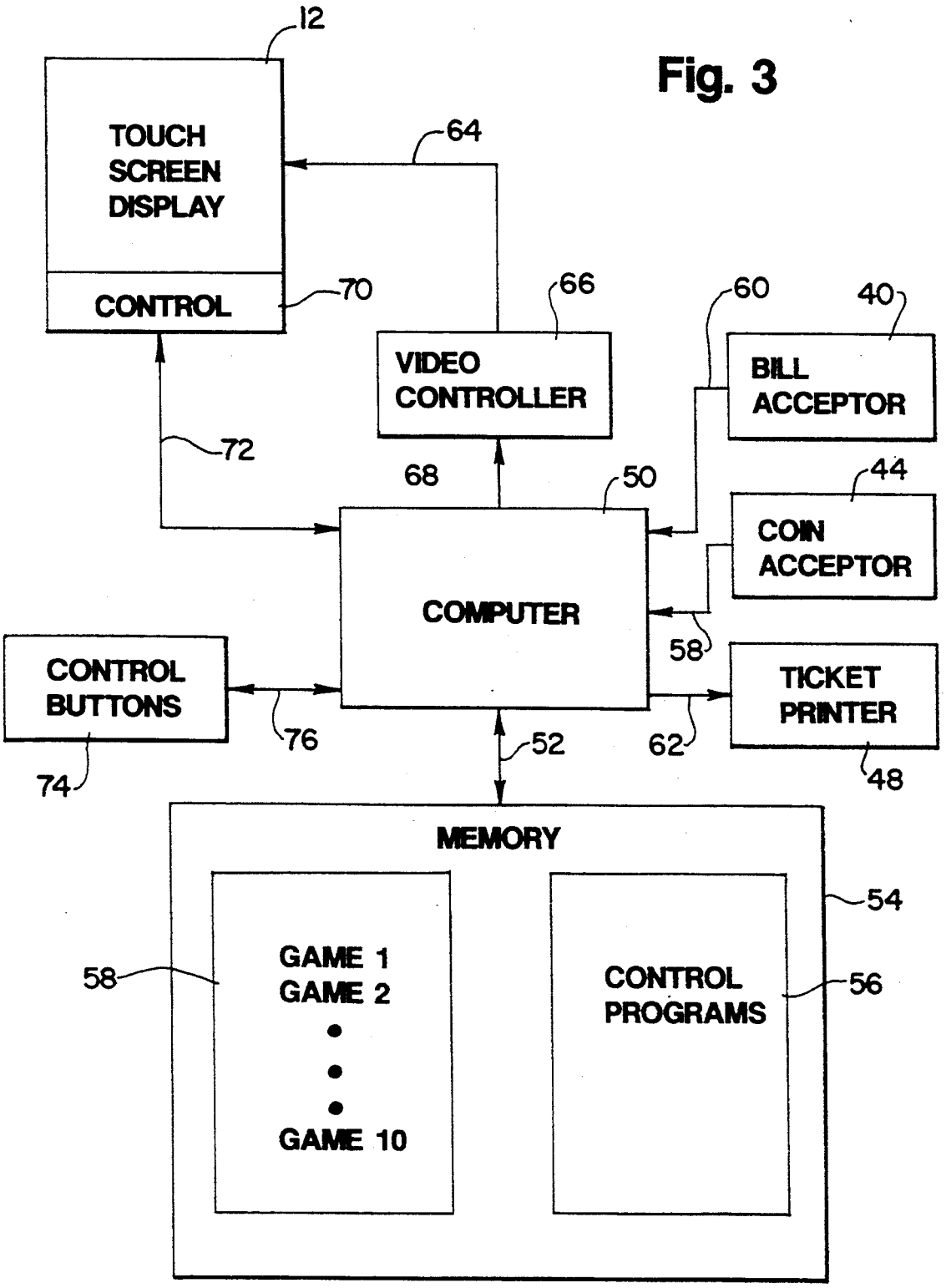
FIG. 3 is a functional block diagram of the machine of FIG. 1.

FIG. 3 is a block diagram of a circuit to implement the operation of the machine 10. A computer 50, preferably a microprocessor, is used to control operation of the machine 10. Connected to the computer as shown by a line 52 is a memory such as an EPROM which contains machine control programs 56 and a set of game control programs 58. In addition the coin acceptor 44, the bill acceptor 46 and the ticket printer 48 are connected to the computer 50 by lines 58, 60 and 62 respectively. The touch screen display 12 is connected via a line 64 to a video display controller 66 which in turn is connected to the computer 50 by a line 68. Displays on the screen 12 are controlled by the computer 50 utilizing the video controller. The touch screen display 12 includes a control circuit 70 which generates a signal on a line 72 which represents the location on the screen 12 which has been touched by a player. Also connected to the computer 50 are circuits represented by a block 74 that respond to depression of the game control buttons 32*a*–32*e* and the machine control buttons 36–42 by transmitting a signal over a line 76 to the computer 50 indicating which button has been depressed.

In the preferred embodiment of the invention when the game selected by the player is a poker game of the type shown in FIG. 1, the computer is programmed so as to accept game control inputs from both the touch screen 12, for example the hold indicators 20*a*–20*e*, and the hold buttons 32*a*–32*e*. As a result the experienced player can play the poker game faster by using the buttons 32*a*–32*e* which will tend to increase his enjoyment of the game while at the same time increase the potential earnings of the machine. On the other hand, the less experienced players can use the touch screen 12 to designate hold cards which can increase his enjoyment of the game and may encourage further play. When a game other than poker, such as the slot machine game of FIG. 2*a*, is selected by the player, the computer 50 is programmed to not accept inputs from the control button circuit 74. Touching the game control buttons 32*a*–32*e* will therefore have no effect on the game. Also to reduce potential player confusion it is considered desirable not to provide an indication to the player, for example an error message on the screen 12, that the buttons 32*a*–32*e* are inoperative for that particular game.

Figure 4:
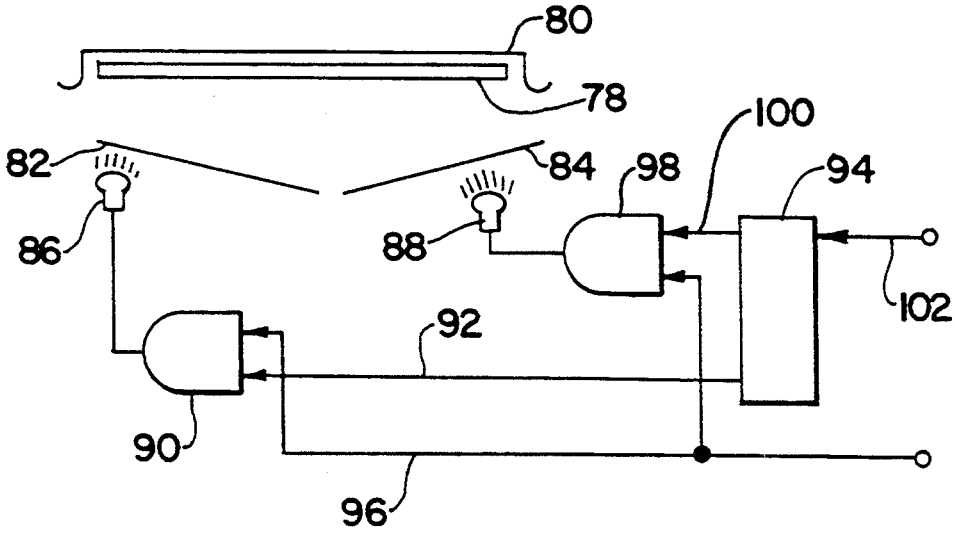
FIG. 4 is a logic diagram of a circuit for selectively displaying labels on control buttons.

Further flexibility can be provided by including a mechanism to automatically change the labels on the game control buttons 32*a*–32*e* to correspond to the selected game. FIG. 4 illustrates one such mechanism. Here a translucent label 78 etched with labels having indicia that are responsive to two different colors or frequencies of light is secured with a transparent button cover 80. Two light filters 82 and 84 are located beneath the label member 78 and are arranged so as to direct light from a pair of light sources such as incandescent bulbs or LEDs 86 and 88 to the label member 78. The light from the source 86 will result in the display of a first label indicia on the member 78 and the light from the source 88 will result in the display of a second label indicia on the member 78. Light sources 86 and 88 can be selectively energized by means of the circuit elements shown in FIG. 4. An AND gate 90 responds to a signal over a line 92 from a flip flop 94 and an enable signal over a line 96 from the computer 50 to energize the light source 86. Similarly, a second AND gate 98 responds to the flip flop 94 via a line 100 and the enable signal on the line 96 to energize the light source 88. For games that utilize the game control buttons 32*a*–32*e*, the labels are enabled by the computer 50 by applying the enable signal to line 50. The indicia label on member 78, which is appropriate for that particular game, is then selected by a signal transmitted from the computer 50 over a line 102 to set the flip flop 94 so as to energize one or the other of the light sources 86 or 88. There are other methods that can be used to change the label indicia on the buttons 32*a*–32*e* including using a bi-colored LED instead of the lamps 86 and 88 or a programmable alphanumeric LED or LCD display secured within the cover 80 operating under control of the computer 50.

We claim:

1. A video gaming machine comprising:

a housing;

a plurality of game control buttons mounted on said housing;

a plurality of machine control buttons mounted on said housing;

control means, including a memory containing a plurality of games, responsive to said game control buttons and machine control buttons for controlling the gaming machine; and a touch screen video display operatively connected to said control means for displaying said games wherein said games include displays of game controls and machine controls for operating said games;

wherein said control means is responsive to either one of said game buttons and said displayed game controls to control at least a first one of said games.

2. The machine of claim 1 wherein said control means is not responsive to inputs from said game control buttons for a second of said games.

3. The machine of claim 2 wherein said control means is responsive to inputs from said machine control buttons for said second game.

4. The machine of claim 2 wherein said first game is a poker game and said game control buttons are hold buttons.

5. The machine of claim 4 wherein said second game is a slot machine game.

6. The machine of claim 1 wherein said game control buttons include at least two labels and wherein said control means includes selection means for selecting one of said labels to correspond to one of said games.

7. The machine of claim 6 wherein said labels include light responsive indicia and wherein said selection means includes a pair of light filters and a pair of light sources associated with each of said labels and a logic circuit connected to said light source for selectively energizing one of said light sources in each of said pairs of light sources.

8. A video gaming machine, comprising:

a computer including memory containing a plurality of games;

means for initiating execution of said games by said computer;

a touch screen display operatively associated with said computer, said touch screen display including means for generating a plurality of touch screen input signals;

a plurality of user-activated electromechanical buttons operatively associated with said computer;

wherein said computer is selectively responsive to both said buttons and said touch screen input signals to control said execution of at least one of said games.

9. The machine of claim 8 wherein said electromechanical buttons include at least two labels and wherein said control means includes selection means for selecting one of said labels to correspond to one of said games.

10. The machine of claim 9 wherein said labels include light responsive indicia and wherein said selection means includes a pair of light filters and a pair of light sources associated with each of said labels and a logic circuit connected to said light source for selectively energizing one of said light sources in each of said pairs of light sources.

11. A video gaming machine comprising:

a housing;

a plurality of game control buttons mounted on said housing;

a plurality of machine control buttons mounted on said housing;

control means, including a memory containing a plurality of games, responsive to said game control buttons and machine control buttons for controlling the gaming machine; and a touch screen video display operatively connected to said control means for displaying said games wherein said games include displays of game controls and machine controls for operating said games;

wherein said control means is responsive to either one of said game buttons and said displayed game controls to control at least a first one of said games;

wherein said game control buttons include at least two labels and wherein said control means includes selection means for selecting one of said labels to correspond to one of said games.

12. The machine of claim 11 wherein said labels include light responsive indicia and wherein said selection means includes a pair of light filters and a pair of light sources associated with each of said labels and a logic circuit connected to said light source for selectively energizing one of said light sources in each of said pairs of light sources.

* * * * *